US007717969B2

(12) United States Patent
Church

(10) Patent No.: US 7,717,969 B2
(45) Date of Patent: May 18, 2010

(54) FUTURE HAUL—ALTERNATIVE FUEL

(76) Inventor: Mike Roy Church, 1120 Cross, Ogden, UT (US) 84404

( * ) Notice: Subject to any disclaimer, the term of this patent is extended or adjusted under 35 U.S.C. 154(b) by 204 days.

(21) Appl. No.: 11/978,633

(22) Filed: Jul. 10, 2007

(65) Prior Publication Data

US 2008/0178520 A1 Jul. 31, 2008

Related U.S. Application Data

(63) Continuation-in-part of application No. 10/901,419, filed on Aug. 29, 2005, now abandoned.

(51) Int. Cl.
*C10L 1/32* (2006.01)

(52) U.S. Cl. ..... 44/301; 44/302

(58) Field of Classification Search ..... 44/301, 44/302

See application file for complete search history.

(56) References Cited

U.S. PATENT DOCUMENTS 6,123,742 A * 9/2000 Smith ..... 44/438

* cited by examiner

*Primary Examiner*—Cephia D Toomer
(74) *Attorney, Agent, or Firm*—Clayton, Howarth & Cannon, P.C.

(57) ABSTRACT

An emulsified liquid fuel utilizes minor proportions of petroleum, maximum proportions of water ($H_2O$) and minimal amounts of acetone and alcohol, all readily available, plentiful and inexpensive.

6 Claims, No Drawings

FUTURE HAUL—ALTERNATIVE FUEL

CROSS REFERENCE TO RELATED APPLICATIONS

This application is a continuation-in-part of U.S. patent application Ser. No. 10/901,419, filed Aug. 29, 2005, now abandoned.

STATEMENT REGARDING FEDERALLY SPONSORED RESEARCH OR DEVELOPMENT

There is not formal "sponsored" research or development at this time, although the formula has been submitted to the United States Department of Energy in June 2006.

THE NAMES OF THE PARTIES TO A JOINT RESEARCH AGREEMENT

N/A

INCORPORATION-BY-REFERENCE OF MATERIAL SUBMITTED ON A COMPACT DISK

N/A

BACKGROUND OF THE INVENTION

1. Field of Invention

My present invention relates to a method of combining relatively inexpensive, readily available, renewable liquids together with fossil fuel to result in affordable, available, emission reducing fuel to be used in regular mass-produced internal combustion engines already manufactured and in the possession of consumers.

2. Background of the Invention

U.S. Pat. Nos. 4,432,308 (Sullivan) and 5,997,591 and Japanese Patent JP55108492

Although all teach that oil or acetone in combination with water produce fuel compositions that reduce pollution, none actually combined all of the elements in the right proportions and with the appropriate additional additive to make the invention usable to a consumer, without engine damage and at a lower cost than the original fuel cost. My invention results in a low-cost, emission free, plentiful fuel which would end dependence on foreign oil immediately.

BRIEF SUMMARY OF THE INVENTION

The invention comprises the emulsified mixture of the following ingredients mixed together in the proportions specified as follows:

synthetic 5W-30 weight motor oil comprising 2% of the mixture by volume;

water comprising 78% of the mixture by volume;

acetone comprising 18% of the mixture by volume;

denatured alcohol comprising between 0.9% and 1% of the mixture by volume;

methanol comprising between 0.9% and 1% of the mixture by volume.

The invention is the result of continuous (since 1989) studies in the combustion of alternative fuel with the goal being that the fuel mixture should burn cleanly and completely Emission testing done on vehicles using the fuel mixture for 12 months resulted in emission testing 35% below allowable emission levels No damage to engine Engines using the fuel mixture have shown no unusual wear or damage Economy The cost of one gallon of mass-produced Future Haul is estimated to be less than $2 a gallon dependent upon distribution Mileage V-8 engine vehicles averaging 15-18 mpg have consistently averaged 37 mpg.

BRIEF DESCRIPTION OF DRAWINGS

N/A

DETAILED DESCRIPTION OF THE INVENTION

My invention was conceived in 1989 and has been extensively tested in various consumer engines as follows:

4 hp Briggs and Stratton lawnmower, which engine ran well, but only until it burned out due to the improper proportions of liquids.

8 hp Briggs and Stratton tiller motor, which with slightly different mixture ran longer and slightly cooler, but eventually burned out as well.

In 2004, new synthetic oil was in production and this mixture was tested in a 2000 Neon automobile.

In 2005, the fuel mixture was tested in a 1980 250 hp single-stroke Yamaha motorcycle with excellent results in fuel burn-off, low emissions and extended mileage.

In 2006, the fuel mixture was tested in 1995 Oldsmobile, which ran well with lower mileage, lower emissions and no engine damage. However, it was noted that if the vehicle sat for periods of time, the fuel separated.

In 2006, the fuel mixture was tested in a 1997 Ford (5.8 V-8) pickup truck resulting in very low emissions testing and 37 mpg.

In 2006, a Dodge Durango (4.7V-8) and a 1986 Toyota 4-Runner.

All vehicles ran well, with lowered emissions, fuel economy and no damage to the engines. Adding the alcohol to the fuel mixture remedies the separation experienced during testing.

The invention claimed is:

1. A fuel comprising a mixture of synthetic 5W-30 weight motor oil comprising 2% of the mixture by volume;

water comprising 78% of the mixture by volume;

acetone comprising 18% of the mixture by volume;

denatured alcohol comprising between 0.9% and 1.1% of the mixture by volume;

and methanol comprising between 0.9% and 1.1% of the mixture by volume.

2. The fuel of claim 1 wherein the ingredients are emulsified.

3. A fuel comprising a mixture of synthetic 5W-30 weight motor oil comprising 2% of the mixture by volume;

water comprising 78% of the mixture by volume;

acetone comprising 18% of the mixture by volume;

denatured alcohol comprising between 0.9% and 1.1% of the mixture by volume, wherein the denatured alcohol comprises the following ingredients mixed together in the following proportions: ethanol comprising between 85% and 90% by volume; methanol comprising between 1% and 4% by volume; and methyl isobutyl ketone comprising between 1% and 5% by volume; and methanol comprising between 0.9% and 1.1% of the mixture by volume.

4. The fuel of claim 3 wherein the ingredients are emulsified.

5. A method for fueling an internal combustion engine comprising:

introducing into the combustion chamber of an internal combustion vehicle a mixture of the following synthetic 5W-30 weight motor oil comprising 2% of the mixture by volume;

water comprising 78% of the mixture by volume;

acetone comprising 18% of the mixture by volume;

denatured alcohol comprising between 0.9% and 1.1% of the mixture by volume;

and methanol comprising between 0.9% and 1.1% of the mixture by volume.

6. The method of claim 5 wherein the mixture is emulsified.

* * * * *